United States Patent [19]

Williams

[11] Patent Number: 4,776,544

[45] Date of Patent: Oct. 11, 1988

[54] GUTTER HANGER

[76] Inventor: Robert M. Williams, 10071 E. Atherton Rd., Davison, Mich. 48423

[21] Appl. No.: 64,906

[22] Filed: Jun. 19, 1987

[51] Int. Cl.[4] ..... E04D 13/06

[52] U.S. Cl. ..... 248/48.1; 52/11

[58] Field of Search ..... 248/48.2, 48.1; 52/11, 52/12, 13, 14, 15, 94, 95, 96

[56] References Cited

U.S. PATENT DOCUMENTS

| | | | |
|---|---|---|---|
| 290,731 | 12/1883 | Bear et al. | 248/48.1 |
| 3,809,347 | 5/1974 | Pekarek | 248/48.1 |
| 3,841,101 | 10/1974 | Henfrey | 61/14 |
| 3,874,131 | 4/1975 | Webster | 52/11 |
| 4,210,301 | 7/1980 | Weiss | 248/48.2 |
| 4,294,422 | 10/1981 | Odekirk | 248/48.2 |
| 4,305,236 | 12/1981 | Williams | 52/11 |
| 4,581,857 | 4/1986 | Harbom | 248/48.2 X |
| 4,631,875 | 12/1986 | Olson | 248/48.2 X |
| 4,632,342 | 12/1986 | Skinner | 248/48.2 |
| 4,669,232 | 6/1987 | Wyatt | 52/12 X |

FOREIGN PATENT DOCUMENTS

| | | | |
|---|---|---|---|
| 0731848 | 4/1966 | Canada | 52/11 |

*Primary Examiner*—Ramon O. Ramirez

*Attorney, Agent, or Firm*—Donald C. Bolger

[57] ABSTRACT

A plastic gutter or eavestrough hanger for plastic symmetrical guttering with a cantilever support member with a lip or plurality of lips to interact with a similar corresponding lip or lips on symmetrical guttering to provide vertical support with lateral rigidity while allowing relative motion between the gutter hanger and the symmetrical guttering during times of expansion and contraction.

22 Claims, 1 Drawing Sheet

GUTTER HANGER

BACKGROUND OF THE INVENTION

This invention relates to gutter or eavestrough hangers and more particularly to hangers for symmetrical guttering made of plastic material.

Symmetrical plastic guttering has been used in guttering systems and is advantageous to other non symmetrical systems. In view of the relatively high coefficient of expansion of plastic materials usually used for this purpose, hangers need to interact with the plastic symmetrical guttering to allow for expansion and contraction.

Gutter hangers that are used with symmetrical guttering use a base support method that is unpleasant in appearance, costly and difficult to install.

It is accordingly an object of this invention to provide a gutter hanger for plastic symmetrical guttering wherein the above disadvantage is substantially eliminated.

According to this invention there is provided a gutter hanger for symmetrical plastic guttering comprising a cantilever support member with a lip or plurality of lips to interact with a corresponding lip or lips on the symmetrical guttering to provide vertical support with lateral rigidity while allowing relative motion between the gutter hanger and the symmetrical guttering during times of expansion and contraction.

It is an object of the present invention to provide a simple, inexpensive and efficient plastic hanger and support which may be quickly and easily applied for attaching symmetrical gutters to a building or structure.

Another object of the present invention is to provide a plastic gutter hanger for symmetrical guttering whereby a symmetrical gutter may be hung in a more convenient and economical manner.

A still another object of the present invention is to provide a plastic gutter hanger which is capable of either snapping into place or capable of being slipped on over the end of the symmetrical gutter and slid to the appropriate attachment position.

A further object of the present invention is to provide a plastic gutter hanger molded into a single piece which can be easily attached from a fascia board, rafter, or structure to a symmetrical gutter.

A still further object of the present invention is to provide a plastic gutter hanger wherein a lip or a plurality of integral lips are provided to interact with a similar lip or plurality of integral lips on symmetrical guttering.

Another object of the present invention is to provide a plastic gutter hanger which walls define a space that provide vertical and lateral support while allowing symmetrical guttering to expand and contract.

Still another object of the present invention is to provide a gutter hanger of the type wherein the opposite ends of a cantilever arm engage with symmetrical guttering for maintaining a predetermined distance between the walls of the symmetrical guttering.

It is another object of the present invention to provide a simplified low cost plastic gutter hanger for symmetrical guttering having certain advantages contributing to efficiency, reliability and durability as well as ease of maintenance.

SUMMARY OF THE INVENTION

The present invention is a plastic support and hanger for symmetrical gutters and the like which can be easily attached to a fascia, rafter, building or structure and overcomes the problem of unpleasant appearance and using high cost non symmetrical guttering.

The gutter hanger has lips or grooves which interact with similar corresponding lips or grooves on the symmetrical guttering. These grooves are part of an engagement means which are attached to a cantilever arm which acts a positioning member and to give lateral support and proper positioning to the symmetrical guttering while also providing vertical support and lateral rigidity during times of expansion and contraction of the guttering.

Advantages of the invention include lips or grooves that can be snapped in place or slid over the end of symmetrical guttering. The gutter hangers can be installed by one person quickly and easily. The appearance of the symmetrical guttering and gutter hangers is greatly improved because most of the gutter hangers cannot be seen from the ground level.

DESCRIPTION OF THE PREFERRED EMBODIMENTS

Figure 1:
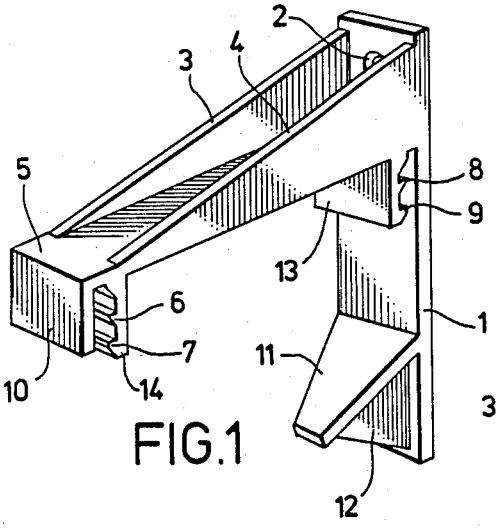
FIG. 1 is a perspective view of a gutter hanger.
Figure 2:
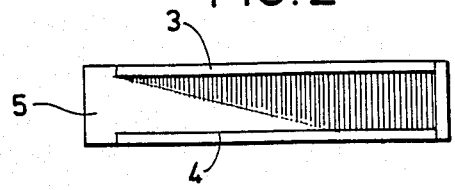
FIG. 2 is a top view of the gutter hanger.
Figure 3:
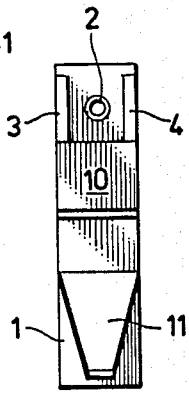
FIG. 3 is a elevation view of the gutter hanger.
Figure 4:
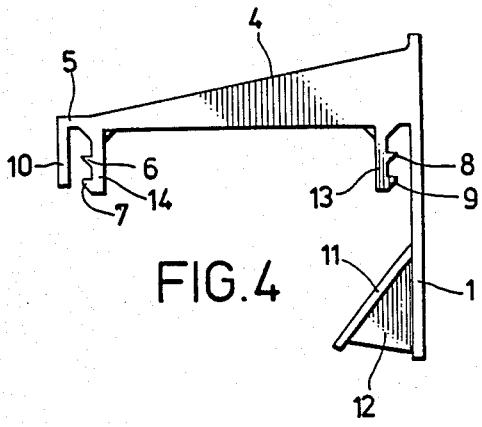
FIG. 4 is an end view of the gutter hanger.

A preferred embodiment of the invention is described below with reference to the accompanying drawings in which:

Referring to FIGS. 1, 2, 3, and 4 the gutter hanger is molded from PVC as a single unit. The gutter hanger is comprised of the following portions:

an inner vertical support portion (1)
a hole (2)
a first cantilever arm portion (3)
a second cantilever arm portion (4)
a horizontal support portion (5)
an upper outer lip portion (6)
a lower outer lip portion (7)
an upper inner lip portion (8)
a lower inner lip portion (9)
an outer vertical support portion (10)
a lateral support portion (11)
a gusset support portion (12)
an inner lip support portion (13)
an outer lip support portion (14)

The gutter hanger has inner vertical support portion 1 with hole 2 for a screw or other fastener horizontally centered along the width of the inner vertical support portion and vertically centered between the top of inner vertical support portion 1 and horizontal support portion 5 for positioning the hanger to a fascia board, rafter, building or structure.

A first cantilever arm portion 3 is attached to the top left edge of the inner vertical support 1. Likewise, a second cantilever arm portion 4 is attached to the top right edge of the inner vertical support 1. The first cantilever arm portion 3 is parallel to second cantilever arm portion 4 and both are at right angles to inner vertical support portion 1.

A horizontal support portion 5 is attached to the bottom of first cantilever arm portion 3 and the bottom of second cantilever arm portion 4 and the face of inner vertical support portion 1. The horizontal support portion 5 is at right angles to the first cantilever arm portion 3, the second cantilever arm portion 4, and the inner vertical support portion 1.

An outer vertical support portion 10 is attached to the horizontal support portion 5 at the end opposite to the inner vertical support 1. The outer vertical support portion 10 is parallel to the inner vertical support 1 and at a right angle to the horizontal support portion 5. The length of the outer vertical support portion 10 is dependent on the type of gutter that is being used and should extend past the lower rib of the gutter.

An inner lip support portion 13 is attached to the horizontal support portion 5. The inner lip support portion 13 is at a right angle to the horizontal support portion 5 and parallel to inner vertical support portion 1. The inner lip support portion 13 is a distance of one gutter width from inner vertical support portion 1. Inner lip support portion 13 has an upper inner lip portion 8 and a lower inner lip portion 9.

The location of the lips is dependent upon the type of gutter being used. Some gutter may require only one lip while others may require more that two lips. The lips are placed at a mirror image to the gutter so that it can snap and be locked in place.

An outer lip support portion 14 is attached to the horizontal support portion 5. The outer lip support portion 14 is at a right angle to the horizontal support portion 5 and parallel to outer vertical support portion 10. The outer lip support portion 14 is a distance of one gutter width from outer vertical support portion 10. Outer lip support portion 14 has an upper outer lip portion 6 and an lower outer lip portion 7. The location of the lips is dependent upon the type of gutter being used. Some gutter may require only one lip while others may require more that two lips. The lips are placed at a mirror image to the gutter so that it can snap and be locked in place.

A lateral support portion 11 is attached to the face of inner vertical support portion 1. The location of lateral support portion 11 is dependent on the type of gutter being used. The lateral support portion 11 should touch the gutter and be parallel to the edge that it supports. A gusset support portion 12 is triangular in shape and is attached to inner vertical support portion 1 and to the bottom of the lateral support portion 11. Gusset support portion 12 gives additional support to lateral support portion 11 which in turn supports the gutter.

What is claimed is:

1. A plastic support and hanger apparatus for symmetrical gutters with a flat base portion, symmetrical front and side wall portions, with one or more lips used for retention and the like comprising:
   - an inner vertical support portion for attachment to the side of structure;
   - an inner lip engagement means for attaching and supporting a symmetrical gutter;
   - an outer lip engagement means for attaching and supporting a symmetrical gutter;
   - a cantilever arm portion extending from said inner vertical support portion attaching to said inner lip engagement means and to said outer lip engagement means;
   - a lateral support portion means for supporting the lower side of a symmetrical gutter.

2. A plastic support and hanger apparatus as recited in claim 1, further comprising:
   - a plurality of inner vertical support portions.

3. A plastic support and hanger apparatus as recited in claim 1, further comprising:
   - a plurality of cantilever arm portions.

4. A plastic support and hanger apparatus as recited in claim 1, further comprising:
   - a plurality of inner lip portions;
   - a plurality of outer lip portions.

5. A plastic support and hanger apparatus as recited in claim 1, further comprising:
   - engagement means wherein an inner lip portion and an outer lip portion engages with corresponding inner lip portion and outer lip portion on a symmetrical gutter.

6. A plastic support and hanger apparatus as recited in claim 1, further comprising:
   - engagement means wherein a plurality of inner lip portions and outer lip portions engage with corresponding inner lip portions and outer lip portions on a symmetrical gutter.

7. A plastic support and hanger apparatus as recited in claim 1, further comprising:
   - engagement means wherein at least one inner and one outer lip engages with corrsponding inner and outer lips on a symmetrical gutter and allows relative motion between the hanger and the symmetrical guttering.

8. A plastic support and hanger apparatus as recited in claim 1, further comprising:
   - engagement means wherein a plurality of inner and outer lips engage with corresponding lips on a symmetrical gutter and allow relative motion between the hanger and the symmetrical guttering.

9. A plastic support and hanger apparatus as recited in claim 1, further comprising:
   - engagement means wherein a plurality of lips engage with a corresponding plurality of lips on the inside walls of a symmetrical gutter and allow relative motion between the hanger and the symmetrical guttering.

10. A plastic support and hanger apparatus for symmetrical gutters with a flat base portion, symmetrical front and side wall portions, with one or more lips used for retention and the like comprising:
   - an inner vertical support portion having a hole for attachment to the side of structure;
   - an inner lip engagement means for attaching and supporting a symmetrical gutter;
   - an outer lip engagement means for attaching and supporting a symmetrical gutter;
   - a cantilever arm portion extending from said inner vertical support portion attaching to said inner lip engagement means and to said outer lip engagement means;
   - a lateral support portion means for supporting the lower side of a symmetrical gutter.

11. A plastic support and hanger apparatus as recited in claim 10, further comprising:
   - a plurality of inner vertical support portions.

12. A plastic support and hanger apparatus as recited in claim 10, further comprising:
   - a plurality of cantilever arm portions.

13. A plastic support and hanger apparatus as recited in claim 10, further comprising:
   - a plurality of inner lip portions;
   - a plurality of outer lip portions.

14. A plastic support and hanger apparatus as recited in claim 10, further comprising:
   - a plurality of lateral support portions.

15. A plastic support and hanger apparatus as recited in claim 10, further comprising:

engagement means wherein an inner lip portion and an outer lip portion engages with corresponding inner lip portion and outer lip portion on a symmetrical gutter.

16. A plastic support and hanger apparatus as recited in claim 10, further comprising:

engagement means wherein a plurality of inner lip portions and outer lip portions engage with corresponding inner lip portions and outer lip portions on a symmetrical gutter.

17. A plastic support and hanger apparatus as recited in claim 10, further comprising:

engagement means wherein at least one inner and one outer lip engages with corresonding inner and outer lips on a symmetrical gutter and allows relative motion between the hanger and the symmetrical guttering.

18. A plastic support and hanger apparatus as recited in claim 10, further comprising:

engagement means wherein a plurality of inner and outer lips engage with a corresponding lips on a symmetrical gutter which allow relative motion between the hanger and the symmetrical guttering.

19. A plastic support and hanger apparatus as recited in claim 10, further comprising:

engagement means wherein a plurality of lips engage with a corresponding plurality of lips on the inside walls of a symmetrical gutter and allow relative motion between the hanger and the symmetrical guttering.

20. A plastic support and hanger apparatus for symmetrical gutters with a flat base portion, symmetrical front and side wall portions, with one or more lips used for retention and the like having:

an inner vertical support portion for attachment to the side of a structure;

an engagement means wherein a plurality of lips engage with a corresponding plurality of lips on the inside walls and outside walls of a symmetrical gutter and allow relative motion between the hanger and the symmetrical guttering;

a cantilever arm portion attaching said inner and outer lip support portions to said engagement means;

a lateral support attached to said inner vertical support portion.

21. A plastic support and hanger apparatus for symmetrical gutters with a flat base portion, symmetrical front and side wall portions, with one or more lips used for retention and the like comprising:

an inner vertical support portion having a attaching hole near the top edge of the vertical support;

a gusset support portion attached to the face of the inner vertical support portion near the lower edge;

a lateral support portion attached to the face of the inner vertical support portion and the top edge of the gusset portion;

a first cantilever arm portion attached to the first vertical edge and near the top of the vertical inner support portion;

a second cantilever arm portion attached to the second vertical edge and near the top of the vertical inner support portion;

a horizontal support portion attached to the bottom of the first cantilever beam portion and the second cantilever beam portion and the face of the inner vertical support portion;

an outer vertical support portion attached to the outer bottom end of the horizontal support portion;

an inner lip support portion having one or more lips attached to the bottom of the horizontal support portion and at a point from the inner vertical support to allow the thickness of a gutter to be snapped into place and retained, an outer lip support portion having one or more lips attached to the bottom of the horizontal support portion and at a point form the outer vertical support to allow the thickness of a gutter to be snapped into place and retained.

22. A plastic support and hanger apparatus for symmetrical gutters with a flat base portion, symmetrical front and side wall portions, with one or more lips used for retention and the like having:

an inner vertical support portion having a attaching hole near the top edge of the vertical support;

a gusset support portion attached to the face of the inner vertical support portion near the lower edge;

a lateral support portion attached to the face of the inner vertical support portion and the top edge of the gusset portion;

a first cantilever arm portion attached to the first vertical edge and near the top of the vertical inner support portion;

a second cantilever arm portion attached to the second vertical edge and near the top of the vertical inner support portion;

a horizontal support portion attached to the bottom of the first cantilever beam portion and the second cantilever beam portion and the face of the inner vertical support portion;

an outer vertical support portion attached to the outer bottom end of the horizontal support portion;

an inner lip support portion having one or more lips attached to the bottom of the horizontal support portion and at a point from the inner vertical support to allow the thickness of a gutter to be snapped into place and retained, an outer lip support portion having one or more lips attached to the bottom of the horizontal support portion and at a point from the outer vertical support to allow the thickness of a gutter to be snapped into place and retained.

* * * * *